US005609146A

United States Patent [19]

Izuta

[11] Patent Number: 5,609,146

[45] Date of Patent: Mar. 11, 1997

[54] WESTERN STYLE BOW

[75] Inventor: Tadao Izuta, Hamamatsu, Japan

[73] Assignee: Yamaha Corporation, Shizuoka, Japan

[21] Appl. No.: 400,977

[22] Filed: Mar. 8, 1995

[30] Foreign Application Priority Data

Apr. 22, 1994 [JP] Japan ..... 6-106175

[51] Int. Cl.[6] ..... F41B 5/00

[52] U.S. Cl. ..... 124/23.1

[58] Field of Search ..... 124/23.1, 86, 88

[56] References Cited

U.S. PATENT DOCUMENTS

| | | | |
|---|---|---|---|
| 2,836,165 | 5/1958 | Bear | 124/23.1 |
| 2,945,488 | 7/1960 | Cravotta et al. | 124/23.1 |
| 2,957,470 | 10/1960 | Barna | 124/23.1 |
| 2,960,084 | 11/1960 | Kramer | 124/23.1 |
| 3,010,445 | 11/1961 | Gruss | 124/23.1 |

FOREIGN PATENT DOCUMENTS

| | | | |
|---|---|---|---|
| 5-52596 | 7/1993 | Japan . | |
| 5-52597 | 7/1993 | Japan . | |
| 750881 | 6/1956 | United Kingdom | 124/23.1 |

OTHER PUBLICATIONS

Paul C. Hougham, "Introductory Information", The Encyclopedia of Archery, page with FIG. 1—Nomenclature drawing of a bow, p. 164, and page with FIG. 29 showing the top and side views of a working recurved bow.

*Primary Examiner*—John A. Ricci
*Attorney, Agent, or Firm*—Koda and Androlia

[57] ABSTRACT

A western style bow including a handle and two limbs mounted to both ends of the handle. A string groove of substantially a V-shaped cross-section is formed at the end of each one of the limbs for accommodating the bowstring. Each groove is deeper at one end than at another end and is wider at one end than at another end so that the bowstring is smoothly guided into the bottom portions of the string grooves after being released.

9 Claims, 9 Drawing Sheets

WESTERN STYLE BOW

BACKGROUND OF THE INVENTION

1. Field of the Invention

The present invention relates to a bow and more particularly to a western style bow that has string grooves for accommodating the bowstring.

2. Prior Art

FIG. 6 shows one of conventional western style bows.

In this bow, the main body 1 of the bow is made of a handle 2 and upper and lower limbs 3 which are detachable from the handle 2. A bowstring S is strung between the tip ends 4*a* of the upper and lower limbs 3. A string groove 6, as shown in FIGS. 7 and 8, is formed for a prescribed length L in the end portion of each one of the limbs 3. The groove 6 is ordinarily 70.0 to 120.0 mm long, and it runs along the central axis O—O of the limb 3 from the tip end 4*a* to the root end 4*b*. In other words, the grooves in the upper and lower limbs are provided in the areas where the bowstring S contacts the face 3*a* of the recurve 5 of the limb 3 when the bowstring is strung on the bow.

The string grooves 6 are provided, as shown in FIGS. 9 and 10, so that the bowstring S is brought back on the central axis O—O of the limbs 3 after being released from a drawn state when an arrow is launched. With these string grooves in the upper and lower limbs, the direction of the launched arrow is stabilized, and the percentage of arrows striking the target is improved.

However, the width dimension W (see FIG. 9) of each of the string grooves 6 of this type of bow is uniform for the entire length within the range of 4.0 to 5.0 mm long as opposed to the bowstring thickness (or diameter) of 2.2 to 2.6 mm that includes the protective layer of a reinforced bowstring. Furthermore, the depth D of the string groove 6 is set to be the same for the entire length so that it is 0.8 to 1.3 mm deep, which is shallower than the thickness of the bowstring S. As a result, the accommodation ratio of the bowstring S into the groove 6 after launching is poor.

In the meantime, in an ideal full drawing of the bowstring, as shown in FIG. 11, the center line p—p of the shoulders of the archer P is parallel to the arrow launch direction X. However, when this parallel relationship is lost, several problems occur. More specifically, when the bowstring is released with the center line p—p of the shoulders not parallel to the arrow launch direction X as a result of the pushing hand of the archer P extending too far outward as shown in FIG. 12 or as a result of the elbow of the pulling hand of the archer P extending too far forward as shown in FIG. 13, the limbs 3 tend to recover in a twisted state. Accordingly, the bowstring S recovering with the limbs 3 strikes the face 3*a* of the limb 3 and does not enter the string grooves 6; in other words, an accurate accommodation of the bowstring S back into the string grooves 6 is not obtained. This disenables the quick and accurate recovery of the bowstring S to the central axis O—O of the limbs 3.

If arrows are repeatedly launched with the limbs 3 under such a twisted condition, twisting deformation can remain in the limbs 3 permanently, and the mutual discrepancy in the recovery of the limbs 3 and bowstring S at the time of release causes an inaccurate return of the bowstring S to the central axis O—O of the limbs 3. As a result, the arrow launch direction X at the time of releasing the arrow becomes skewed, creating a constant error in the left-right direction and decreasing the percentage of arrows striking the target.

Furthermore, some bows use limbs that are of a sandwich or laminated structure. In these types of sandwich-structured limbs, as shown in FIG. 10, FRP (fiber reinforced plastics) layers 32, that use glass fibers, carbon fibers, etc., as reinforcing fibers, are laminated on the front and back surfaces of a wooden core 31, and the string grooves 6 are formed by cutting into the FRP layer 32. When the FRP layers are thus cut for forming the grooves, chances are that the reinforcing fibers in the FRP layer 32 on the face 3*a* side of the limb would be cut into.

Such cutting of the reinforcing fibers in the FRP layers 32 of the limbs 3 causes a drop in the bending and twisting rigidity and a strength decrease in the limbs 3, and it is also extremely dangerous. Splitting, etc. would occur in the groove-worked areas of the string grooves 6. In order to avoid such damages, the depth D of the string grooves 6 is inevitably limited, and deep string grooves are not able to be created.

SUMMARY OF THE INVENTION

Accordingly, the object of the present invention is to provide a western style bow that is free of twisting deformation in the limbs that might occur as permanent strain due to repeated use.

The object is substantially accomplished by increasing the capacity of the string grooves to accommodate the bowstring back thereinto after an arrow has been launched, and it is ensured that the limbs and bowstring are restored to accurate positions so that the direction in which the arrow is launched is stabilized, the percentage of arrows which strike the target is improved, and a drop in the rigidity and strength of the limbs is prevented.

The object is accomplished by a unique structure for a western style bow that is provided with a bowstring strung between the tip ends of the upper and lower limbs of the handle of the bow and string grooves formed in the face sides of the respective recurves of the upper and lower limbs so that the string grooves have a prescribed length along the center axis of the bow from the tip ends to the root ends of the limbs for accommodating the bowstring when an arrow is launched, and the unique structure of the present invention is that the bottom portions of the string grooves have a uniform width and the side walls of the grooves are formed inclined so that the grooves are wider at the opening and narrower at the bottom portions.

In addition, the width of the string groove side walls becomes gradually narrower from the tip ends to root ends of the limbs. In other words, the string groove is wider at the tip end and narrower at the root end along the axis of each limb.

Moreover, the depth of the string grooves gradually becomes shallower from the tip ends to root ends of the limbs. In other words, the string groove is shallower at the tip end and deeper at the root end along the axis of each limb.

Furthermore, the string grooves are formed simultaneously with the formation of the limbs so that there is no need to cut into the FRP layer to form the grooves.

With the structure above, when the bowstring initially contacts the recurves of the limbs after being released, the bowstring is guided to the bottom portions of the string grooves by the inclined surfaces of the side walls of the string grooves. Thus, the capacity of the string grooves to accommodate the bowstring is remarkably high, and the bowstring can always be positioned on the central axes of the limbs. This is because in the bow of the present invention the bottom portions of the string grooves have a uniform width, and the side walls of the string grooves are inclined so that the grooves become narrower towards the bottom portions. As a result, twisting deformation of the limbs that can be a permanent strain due to repeated use as seen in the conventional bows is prevented.

Furthermore, the opening width of the string grooves gradually becomes narrower from the tip ends to the root ends of the limbs. Thus, the bowstring is easily, smoothly and accurately guided to the bottom portions of the string grooves when the bowstring initially contacts the recurves of the limbs after being released.

Moreover, the depth of the string grooves becomes shallower from the tip ends to the root ends of the limbs. Thus, the bowstring is smoothly guided into the bottom portions of the string grooves when the bowstring initially contacts the recurves of the limbs after being released.

In addition, the string grooves are formed by being molded simultaneously with the formation of the limbs which are of a sandwich structure having FRP layers laminated on both sides of a wooden core. In other words the string grooves are obtained by molding and not by cutting into the FRP layer. Thus, cutting of the reinforcing fibers in the FRP layer is prevented unlike in the conventional bows. As a result, a drop in the rigidity and strength of the limbs is prevented, and the string grooves can be formed deep enough.

DETAILED DESCRIPTION OF THE INVENTION

Figure 1:
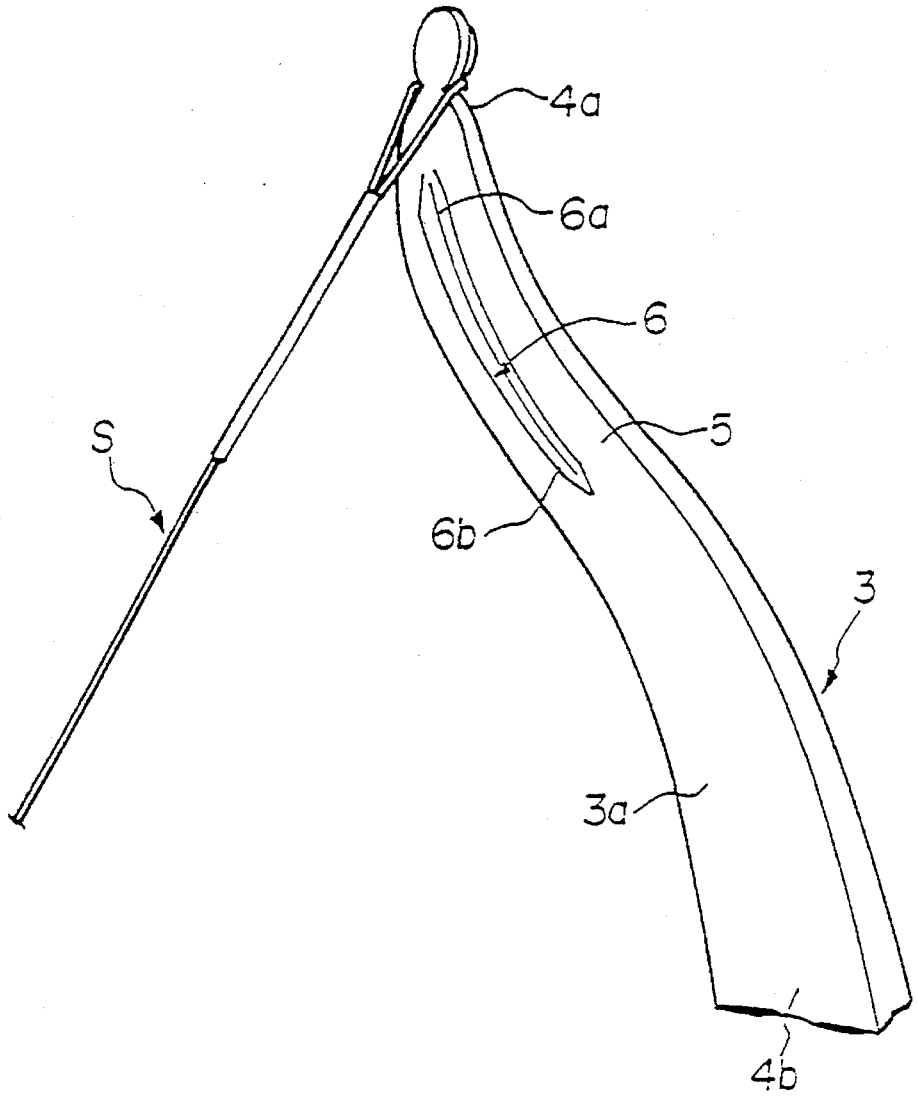
FIG. 1 shows the essential portion of one of the limbs in the drawn state of one embodiment of the western style bow according to the present invention.

One embodiment of the present invention will be described in detail with reference to FIGS. 1 through 5. Elements that are the same as those of the conventional bow shown in FIGS. 6 to 10 will be described using the same reference numbers.

The western style bow of the present invention includes upper and lower limbs 3 which are connected to both ends of a handle. The bowstring S is strung between the tip ends of the limbs 3. In the Figures, only one of the limbs 3 is shown.

Each one of the limbs 3 is provided with a string groove 6 (only one is shown) in the face 3*a* of the recurve 5 of the limb 3 so as to be longitudinal or parallel to the central axis O—O of the limb 3 and to face the bowstring S.

Figure 4:
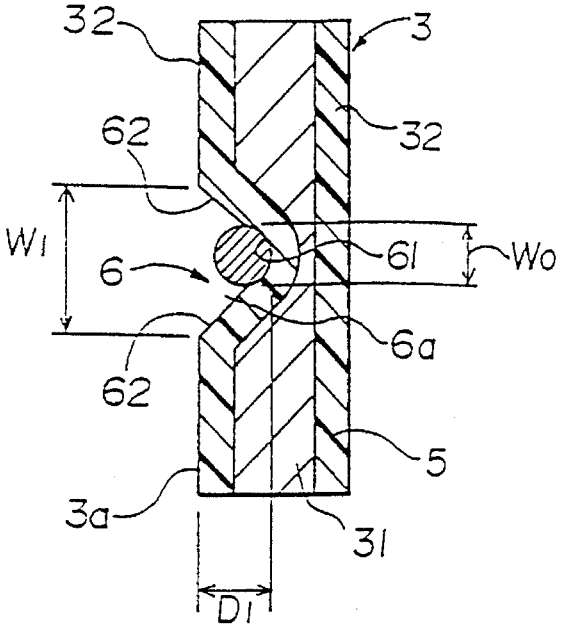
FIG. 4 is a cross section taken along the line 4—4 in FIG. 3.
Figure 5:
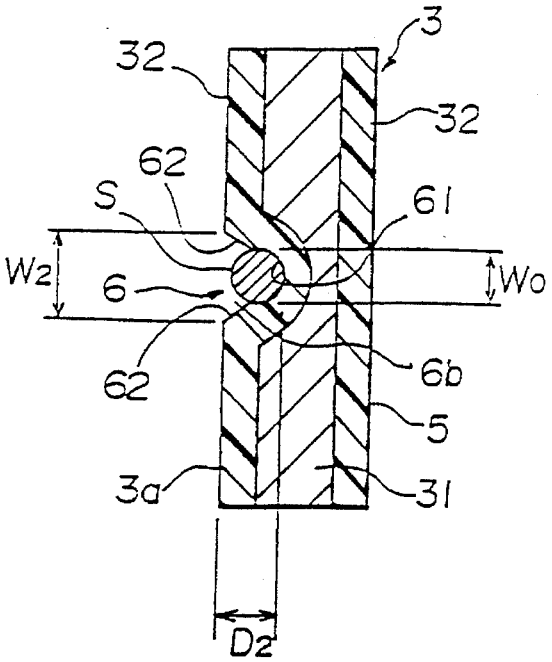
FIG. 5 is a cross section taken along the line 5—5 in FIG. 3.
Figure 6:
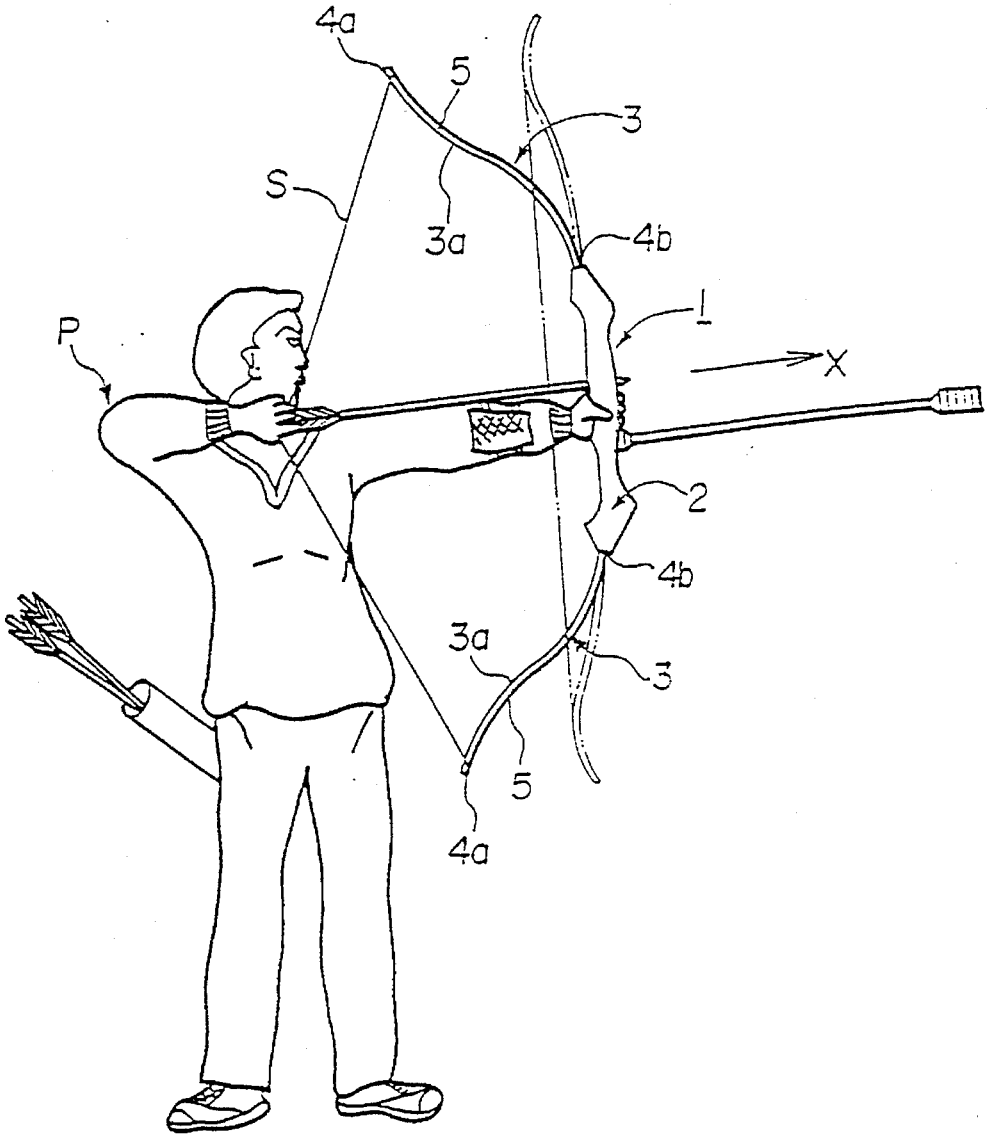
FIG. 6 PRIOR ART
FIG. 6 shows the drawing of the bow by an archer using a conventional bow.
Figure 7:
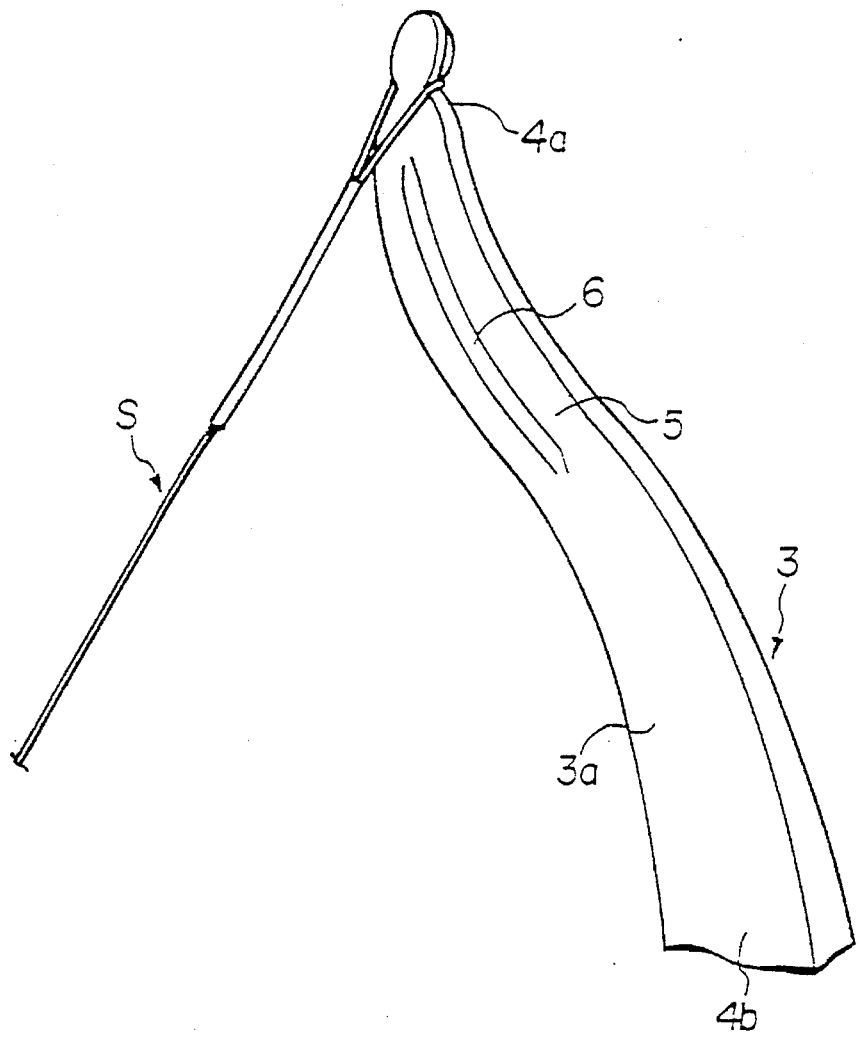
FIG. 7 PRIOR ART
FIG. 7 is an enlarged perspective view of the end portion of the conventional bow of FIG. 6.
Figure 8:
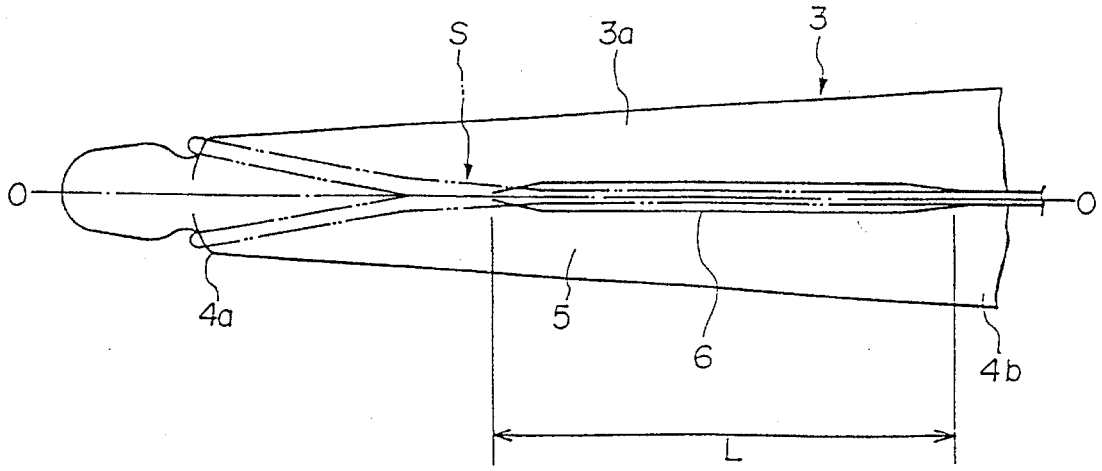
FIG. 8 PRIOR ART
FIG. 8 shows the face thereof.
Figure 9:
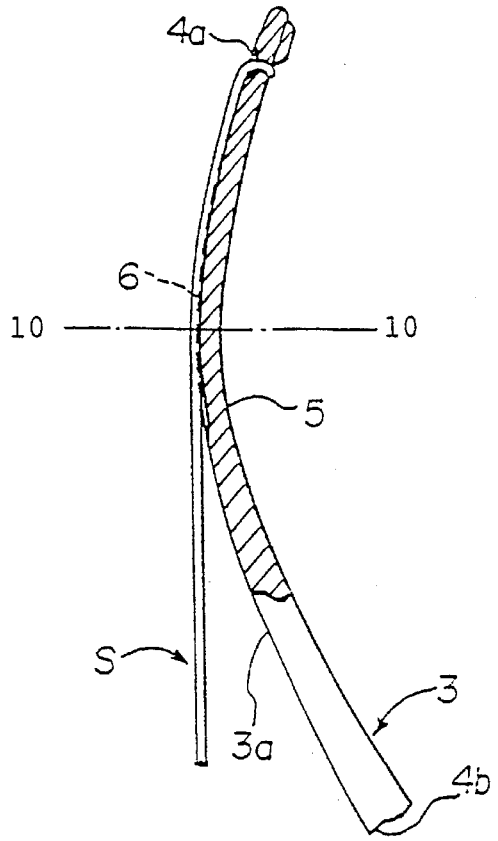
FIG. 9 PRIOR ART
FIG. 9 is a longitudinal sectional side view thereof.
Figure 10:
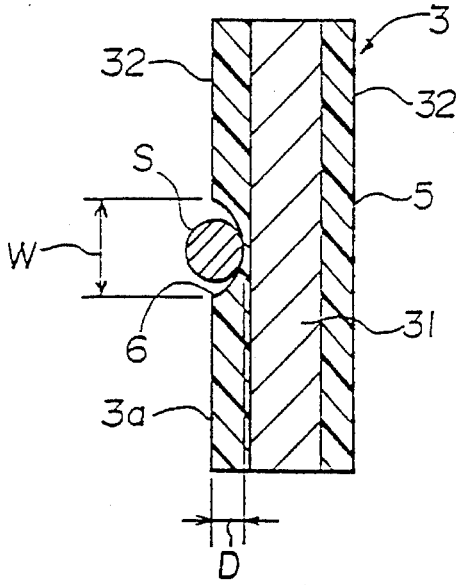
FIG. 10 PRIOR ART
FIG. 10 is a cross section taken along the line 10—10 in FIG. 9.
Figure 11:
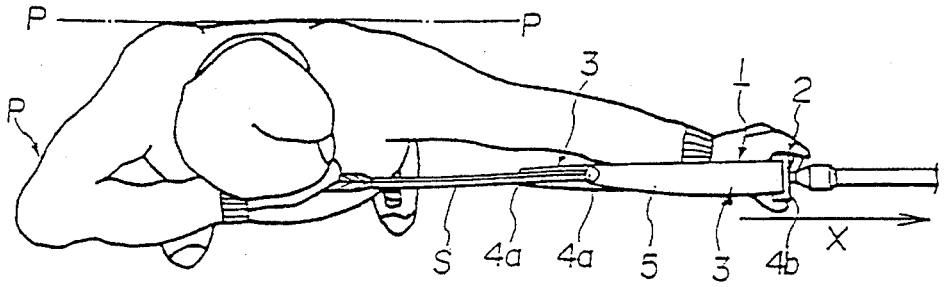
FIG. 11 shows an ideal bow drawing posture by an archer.
Figure 12:
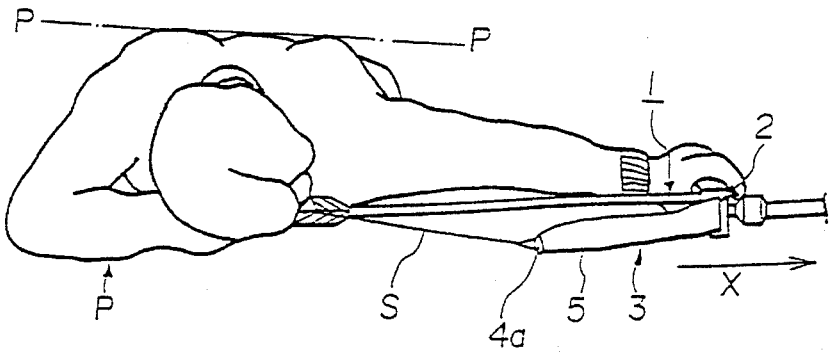
FIG. 12 shows bow drawing posture in which the shoulder of the pushing hand of the archer projects too far outside.
Figure 13:
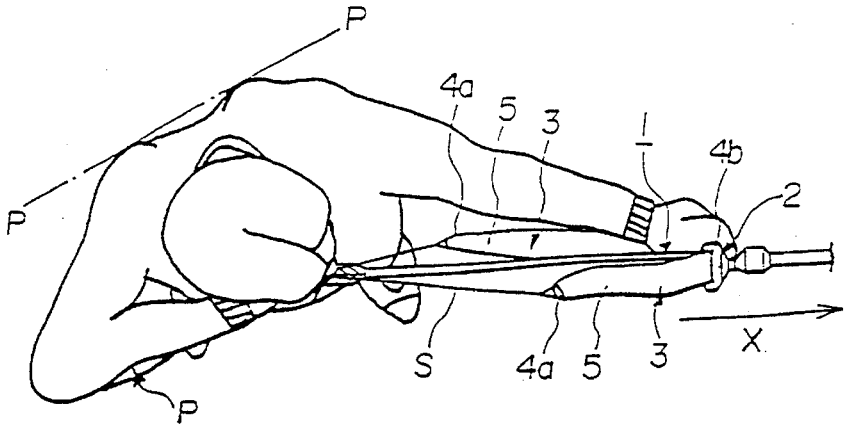
FIG. 13 shows another bow drawing posture in which the elbow, of the pulling hand of the archer projects too far forward.

Each groove 6 is in a prescribed length along the central axis O—O (see FIG. 2), and it runs from the tip end 4*a* to the root end 4*b* of the limb 3. As shown in FIGS. 4 and 5, the bottom portion 61 of the string groove 6 has a uniform width dimension WO for the entire length of the groove along the axis O—O. Furthermore, the side walls 62 of the string groove 6 that extend from the bottom portion 61 of the groove 6 are formed as inclined surfaces so that the groove 6 is wider toward the face 3*a* as seen from FIGS. 2 through 5. In other words, the groove 6 is narrower at the bottom portion than at the opening edge that is on the face 3*a* of the limb 3, thus being substantially V-shape in cross section.

Figure 2:
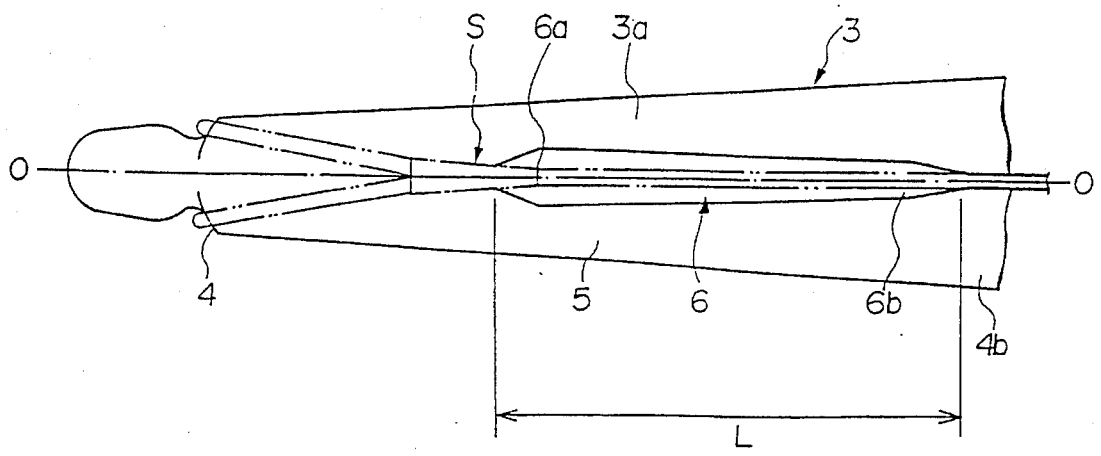
FIG. 2 shows the face of the limb.
Figure 3:
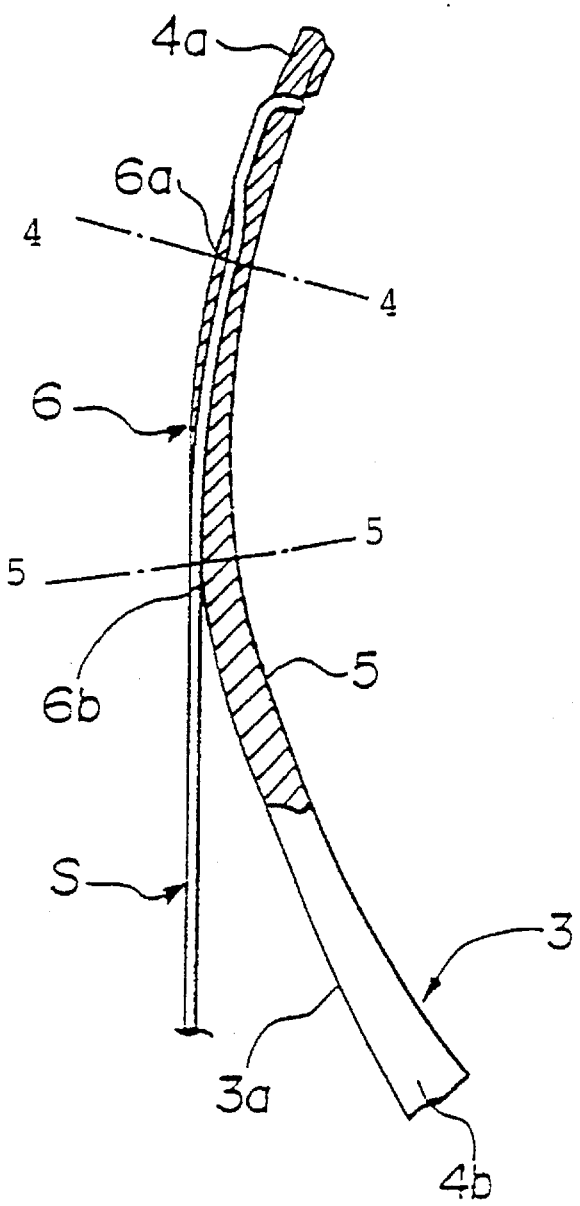
FIG. 3 is a longitudinal sectional side view of the limb after the bowstring has been released.

More specifically, the width dimension WO of the bottom portion 61 of the string groove 6 is set to be in the range of 2.6 to 3.5 mm, preferably 2.6 to 3.0 mm, and the opening width of the side walls 62 of the grooves which have an open inclination is set to be in the range of 4.0 to 12.0 mm, preferably 5.0 to 8.0 mm. Thus, the width dimension WO of the bottom portion of the string groove is smaller or narrower than the opening width or the open edge of the string groove. In addition, the width W1 at point 6*a* which is near the tip end 4*a* of the limb 3 is set to be the widest, and it gradually becomes narrower toward the root end 4*b* of the limb 3. Thus, as best seen in FIG. 2, the opening width of the groove is the narrowest at point 6*b* which is near the root end 4*b* of the limb 3.

Furthermore, each of the limbs 3 is formed in a sandwich structure. In other words, FRP layers 32 are laminated on the front and back surfaces of a wooden core 31 as shown in FIGS. 4 and 5, and the string groove 6 is formed as a recess in one of the FRP layers 32 that is located on the face side (or on the left side layer 32 in FIG. 5) of the limb 3 by molding simultaneously when the limb 3 is made. In other words, the string groove 6 is formed at the same time when the limb 3 is made, and the groove 6 is not made by cutting or engraving but by molding.

Since the string grooves 6 are molded at the time of molding the limbs 3, the overall depth dimension of the string groove 6 can be increased compared to the prior art so as to be the value in the range of 1.5 to 3.5 mm, preferably in the range of 2.2. to 2.6 mm, that corresponds to the thickness of the bowstring S. The distribution of the depth dimension of the string groove 6 is set so that the depth of the groove gradually becomes shallower from the point 6*a* which is near the tip end 4*a* to the point 6*b* which is near the root end 4*b* of the limb 3.

As seen from the above, in the present invention, the bottom surfaces of the string grooves which are formed for a prescribed length along the central axis (running from the tip ends of the limbs toward the root ends of the limbs) in the faces of the recurves of the limbs which come in contact with the bowstring are formed so as to have a uniform or constant width. In addition, the side walls of the string grooves are formed as inclined surfaces which open wider toward the face sides. The string grooves are narrower at the bottom portions than the opening edges. Accordingly, when the bowstring contacts the recurves of the limbs after being released, the bowstring is forcibly guided toward the bottom portions of the string grooves by the inclined surfaces of the side walls of the string grooves. Thus, the capability of the string grooves to receive the bowstring is high, and the bowstring can always be positioned on the central axis of the limbs.

As seen from the above, the twisting deformation of the limbs that can be permanent due to repeated use, as encountered in the conventional bows, is prevented, and the limbs and bowstring can always be restored to accurate positions during recovery. Accordingly, the direction in which the arrow is launched at the time that the arrow is released is stable, and the percentage of arrows striking the target is improved.

Furthermore, the opening width of the string groove side walls which have an inclination gradually becomes narrower from the tip ends toward the root ends of the limbs. Accordingly, the bowstring can be smoothly guided to the bottom portions of the string grooves when the bowstring initially contacts the recurves of the limbs after being released.

Moreover, the depth of the string grooves gradually becomes shallower from the tip ends to the root ends of the limbs. This structure also helps the bowstring to be guided to the bottom portions of the string grooves when the bowstring initially contacts the recurves of the limbs after being released.

Furthermore, the string grooves are formed as recesses by being molded simultaneously with the formation of the limbs that are of a sandwich structure in which FRP layers are laminated on both sides of a core, and the grooves are obtained without cutting into the FRP layer. As a result, the reinforcing fibers in the FRP layer is not cut into, and the rigidity and strength drop in the limbs are avoided. It is also possible to form the string grooves deeper than those of the prior art bows.

I claim:

1. A western style bow in which a bowstring is strung between tip ends of upper and lower limbs of said bow and string grooves are formed in faces of respective recurves of said upper and lower limbs contacted by said bowstring, wherein said string grooves run for a prescribed length along a central axis of said bow from tip ends of said limbs toward root ends of said limbs so that said bowstring which is released when an arrow is launched is accommodated in said string grooves, bottom surfaces of said string grooves are formed so as to have a uniform width, side walls of said grooves are formed as inclined surfaces which open toward said face of said bow and said string grooves are substantially V-shaped in cross section.

2. A western style bow in which a bowstring is strung between tip ends of upper and lower limbs of said bow and string grooves are formed in faces of respective recurves of said upper and lower limbs contacted by said bowstring, wherein said string grooves run for a prescribed length along a central axis of said bow from tip ends of said limbs toward root ends of said limbs so that said bowstring which is released when an arrow is launched is accommodated in said string grooves, bottom surfaces of said string grooves are formed so as to have a uniform width, side walls of said grooves are formed as inclined surfaces which open toward said face of said bow, an opening width of said inclined surfaces gradually becomes narrower from said tip ends of the limbs to said root ends of said limbs and said string grooves are substantially V-shaped in cross section.

3. A western style bow in which a bowstring is strung between tip ends of upper and lower limbs of said bow and string grooves are formed in faces of respective recurves of said upper and lower limbs contacted by said bowstring, wherein said string grooves run for a prescribed length along a central axis of said bow from tip ends of said limbs toward root ends of said limbs so that said bowstring which is released when an arrow is launched is accommodated in said string grooves, bottom surfaces of said string grooves are formed so as to have a uniform width, side walls of said grooves are formed as inclined surfaces which open toward said face of said bow, an opening width of said inclined surfaces gradually becomes narrower from said tip ends of the limbs to said root ends of said limbs, a depth of said string grooves gradually becomes shallower from said tip ends of said limbs to said root ends of said limbs and said string grooves are substantially V-shaped in cross section.

4. A western style bow in which a bowstring is strung between tip ends of upper and lower limbs of said bow and string grooves are formed in faces of respective recurves of said upper and lower limbs contacted by said bowstring, wherein said string grooves run for a prescribed length along a central axis of said bow from tip ends of said limbs toward root ends of said limbs so that said bowstring which is released when an arrow is launched is accommodated in said string grooves, said limbs are of a sandwich structure in which FRP layers are laminated on front and back surfaces of a core, said string grooves are molded simultaneously with a formation of said limbs without cutting into said FRP layer located on said face of said bow and said string grooves are substantially V-shaped in cross section.

5. A western style bow comprising a handle, a pair of limbs connected to both ends of said handle, and a bowstring strung between tip ends of said limbs, each of said limbs being provided with a longitudinal string groove facing said bowstring, wherein said string groove has a constant bottom width, a variable opening width and a variable depth for the length of said string groove, said string groove comprises a bottom portion and two inclined side walls extending from said bottom portion and said string groove is substantially V-shaped in cross section.

6. A western style bow according to claim 5, wherein said opening width of said string groove varies such that said width is wider at one end of said string groove than at another end of said string groove.

7. A western style bow according to claim 6, wherein said opening width of said string groove varies such that said width is becomes gradually narrower toward said another end of said string groove.

8. A western style bow according to claim 5, wherein said string groove varies such that said string groove is deeper at one end of said string groove than at another end of said string groove.

9. A western style bow according to claim 8, wherein said depth of said string groove becomes gradually shallower from said one end of said string groove toward said another end of said string groove.

* * * * *